US006609516B2

(12) United States Patent
Hollander et al.

(10) Patent No.: US 6,609,516 B2
(45) Date of Patent: Aug. 26, 2003

(54) SMOKE ESCAPE MASK

(75) Inventors: David S. Hollander, Brooklyn, NY (US); Karen Hollander, Brooklyn, NY (US)

(73) Assignee: Fire Drill, LLC, Rosedale, NY (US)

( * ) Notice: Subject to any disclaimer, the term of this patent is extended or adjusted under 35 U.S.C. 154(b) by 0 days.

(21) Appl. No.: 10/075,546

(22) Filed: Feb. 14, 2002

(65) Prior Publication Data

US 2002/0104543 A1 Aug. 8, 2002

Related U.S. Application Data

(63) Continuation-in-part of application No. 09/706,632, filed on Nov. 6, 2000, now Pat. No. 6,453,902, which is a continuation-in-part of application No. PCT/US99/13513, filed on Jun. 16, 1999.

(60) Provisional application No. 60/089,678, filed on Jun. 17, 1998.

(51) Int. Cl.[7] ..... A62B 18/08

(52) U.S. Cl. ..... 128/201.17; 128/201.12; 128/205.25; 128/206.23; 128/206.24; 128/206.25

(58) Field of Search ..... 128/201.17, 201.12, 128/205.25, 206.23, 206.24, 206.25, 201.15, 201.25, 205.28, 205.29, 206.12, 206.17, 206.19, 201.24, 205.27

(56) References Cited

U.S. PATENT DOCUMENTS

| | | | | | |
|---|---|---|---|---|---|
| 3,695,265 | A | | 10/1972 | Brevik | |
| 4,004,584 | A | | 1/1977 | Geaney | |
| 4,032,991 | A | | 7/1977 | Vandeweghe | |
| 4,240,420 | A | | 12/1980 | Riaboy | |
| 4,354,489 | A | | 10/1982 | Riaboy | |
| 4,382,440 | A | | 5/1983 | Kapp et al. | |
| 4,467,799 | A | | 8/1984 | Steinberg | |
| 4,643,182 | A | | 2/1987 | Klein | |
| 4,856,535 | A | | 8/1989 | Forbes | |
| 4,984,302 | A | | 1/1991 | Lincoln | |
| 5,009,225 | A | * | 4/1991 | Vrabel | 128/201.24 |
| 5,094,236 | A | | 3/1992 | Tayebi | |
| 5,322,060 | A | | 6/1994 | Johnson | |
| 5,400,780 | A | | 3/1995 | Nishino | |
| 5,706,828 | A | | 1/1998 | Shiota | |
| 5,765,556 | A | * | 6/1998 | Brunson | 128/206.19 |
| 6,453,902 | B1 | * | 9/2002 | Hollander et al. | 128/201.17 |

* cited by examiner

*Primary Examiner*—Weilun Lo
*Assistant Examiner*—Darwin P. Erezo
(74) *Attorney, Agent, or Firm*—St. Onge Steward Johnston & Reens

(57) ABSTRACT

A smoke mask includes a generally planar breathing filter sized to cover the nose and mouth of a user. The breathing filter may be either dry or moistened, and has a filter efficiency of at least about 95%, meaning that at least about 95% of charge neutralized particles having an approximate size of 0.3 micrometers are removed from air flowing at a rate in a range of about 81 liters per minute to about 89 liters per minute, with a total filter load of at least about 200 milligrams of the particles. A transparent eye shield, which may be either a plastic film or goggles, is attached to the breathing filter. Pressure sensitive adhesive is located on the peripheral edge of one surface of the mask structure for securing the mask to the face of the user.

24 Claims, 16 Drawing Sheets

SMOKE ESCAPE MASK

RELATED APPLICATIONS

This is a continuation-in-part of U.S. patent application Ser. No. 09/706,632, filed Nov. 6, 2000, now U.S. Pat. No. 6,453,902 B7, which is a continuation-in-part of PCT Application Serial No. PCT/US99/13513, filed Jun. 16, 1999, which claims the benefit of U.S. Provisional Patent Application Serial No. 60/089,678, filed Jun. 17, 1998, the contents of each of which are incorporated herein in their entirety.

FIELD OF THE INVENTION

The present invention relates generally to a fire escape mask, and more particularly to a fire escape mask, which may be either dry or moistened, and pull-apart storage structure for the mask. The mask is configured with an eye shield, and slits in a peripheral edge thereof to adhere tightly to the face of the wearer when in use, and may be stored flat or in a canister.

BACKGROUND OF THE INVENTION

It is well-known that smoke inhalation is the leading cause of fire deaths, exceeding burn deaths by roughly two to one. The percentage of fire deaths attributable to smoke inhalation has been increasing approximately one percent annually since at least 1979.

Masks suitable for use to prevent or reduce smoke inhalation in a fire are well known in the art. The most common type of mask is that used by professional firefighters. This type of mask consists of a mask portion covering the face, an air tank containing a supply of air, and an air regulator. While this type of mask configuration is suitable for professional firefighters, it is too expensive, complex, and bulky for general consumer use.

According to the fire safety guidebook *Get Out Alive*, which is endorsed by the U.S. Fire Administration, the recommended and almost universally endorsed method of filtering smoke during a fire is to place a wet cloth over the nose and mouth before escaping. The wet cloth absorbs some of the smoke particles and filters noxious substances in the smoke, thereby reducing smoke inhalation. While the use of a wet cloth will not eliminate smoke inhalation, its purpose is to reduce smoke inhalation for a sufficient amount of time to escape the smoky condition. The more time that is available to the person to escape before being overcome by smoke, the greater the likelihood of survival.

A number of devices have been proposed to perform the function of the wet cloth described above. Johnson, U.S. Pat. No. 5,322,060, relates to a fire resistant mask which is made of a flexible breathable porous material impregnated with a solution containing ammonium biborate, ammonium phosphate, ammonium sulfate, sodium dodecyl sulfate, lanolin, lemon fragrance, and water. The mask is breathable and has adsorption capacity for capturing smoke particles and for filtering gases. The mask is constructed of a polyurethane foam covered with terry cloth, and is attached to the face of the user with an elastic strap. The fire resistant masks are packaged wet in moisture barrier packaging.

This type of device suffers from several shortcomings. First, it does not seal well over the mouth and nose of the user. As a result, smoke is able to bypass the mask, thereby reducing its effectiveness. Second, this type of device, while requiring less storage space than the air-canister type mask discussed above, is awkwardly shaped and requires more storage space than is otherwise desirable. As a result, smoke escape masks of this type do not appear to have met with commercial success. Other such bulky mask are shown in Klein, U.S. Pat. No. 4,643,182, and Steinberg, U.S. Pat. No. 4,467,799.

Vandeweghe, U.S. Pat. No. 4,032,991 discloses a smoke escape hood that includes a porous face mask over a portion of the face of the wearer. The smoke escape hood is stored flat, with the face mask kept wet by a moisture impermeable sealing strip. The hood is made of a fire and heat resistant sheet material, such as tetrafluorocarbon, and the mask is constructed of a plurality of rectangular plies of woven fabric. The mask itself is moistened with water or other fluid, and may include granular carbon. When the hood is placed over the head of the wearer, draw strings are provided on the lower portion of the mask to tie the mask to the head of the wearer.

This type of device, and others like it that attach to the wearer using a band, e.g., U.S. Pat. Nos. 4,643,182 and 5,400,780, also do not provide a tight seal around the face of the wearer, thereby enabling smoke to bypass the mask. Also, from a practical standpoint, a user of the Vandeweghe device may be disinclined to wear a hood over his/her head.

Another type of mask that has been proposed utilizes pressure-sensitive adhesive to attach the mask to the face of the user. Devices of this type are shown, for example, in U.S. Pat. Nos. 4,467,799; 4,354,489; 4,240,420; 4,984,302; 4,004,584 and 3,695,265. While, in principle, a pressure-sensitive adhesive attachment to the wearer provides a tight seal for preventing smoke from bypassing the filter, in practice, the design of these masks ignores the fact that the mask may be required to be worn by users of different sizes, with different facial features. In practice, when the masks are applied to the faces of those wearers whose size/facial features do not correspond to the size/shape of the mask, some creasing of the mask will occur, thereby enabling smoke to bypass the mask.

To the inventors' knowledge, despite the near-universal awareness that covering the nose and mouth of a person with a wet cloth in a smoky condition greatly improves the likelihood of survival, no mask for this purpose has achieved commercial success. Accordingly, it is an object of the present invention to provide a fire escape mask that provides a tight seal around the face of wearers of different sizes/facial contours to prevent smoke from bypassing the mask, that may be stored in a convenient storage structure that will be readily available for use by the user and that protects the mask from damage, that includes eye protection through which the user will readily and that overcomes the other aforementioned shortcomings of prior mask designs.

SUMMARY OF THE INVENTION

The present invention is a smoke mask having a generally planar breathing filter, which may be moistened or dry, sized to cover the nose and mouth of a user. A transparent eye shield, which is preferably either a plastic film or goggles, is attached to the breathing filter. Pressure sensitive adhesive is located on the peripheral edge of one surface of the mask for securing the mask to the face of the user covering the mouth, nose and eyes of the user. A release sheet, which is preferably a translucent plastic film, covers the adhesive so that the adhesive is exposed upon removal of the release sheet. The breathing filter is preferably attached directly to the eye shield by means of sonic welding, heat sealing, adhesive, stitching or the like.

The breathing filter has a filter efficiency of at least about 95%, meaning that at least about 95% of charge neutralized particles having an approximate size of 0.3 micrometers are removed from air flowing at a rate in a range of about 81 liters per minute to about 89 liters per minute, with a total filter load of at least about 200 milligrams of the particles.

The smoke mask may include one or more slits in the peripheral edge of the mask structure for enabling the mask structure to adapt to the contour of the face of the user. The mask structure and/or release sheet include at least one pull-apart tab for being grasped by a user.

The smoke mask may be used in combination with a storage structure, preferably a waterproof storage structure when a moistened filter is used whereby the smoke mask is stored within the waterproof storage structure in a wetted condition. If a dry filter is used, a waterproof storage structure is not necessary. In a preferred embodiment, the storage structure is a canister comprising threaded halves, or a canister that is sealed by means of a pull-off cover or a threaded cover. The smoke mask is preferably rolled within the canister for storage.

An alternative embodiment of the invention includes, in combination:

(i) a smoke mask structure comprising a breathing filter having a peripheral edge, pressure sensitive adhesive on the peripheral edge of the smoke mask structure on one surface thereof for securing the mask structure to the face of the user, and a release sheet covering the adhesive, wherein the adhesive is exposed upon removal of the release sheet; and (ii) a canister in which the smoke mask structure is stored until use.

The invention and its particular features and advantages will become more apparent from the following detailed description considered with reference to the accompanying drawings.

DETAILED DESCRIPTION OF AN EMBODIMENT OF THE INVENTION

Figure 1:
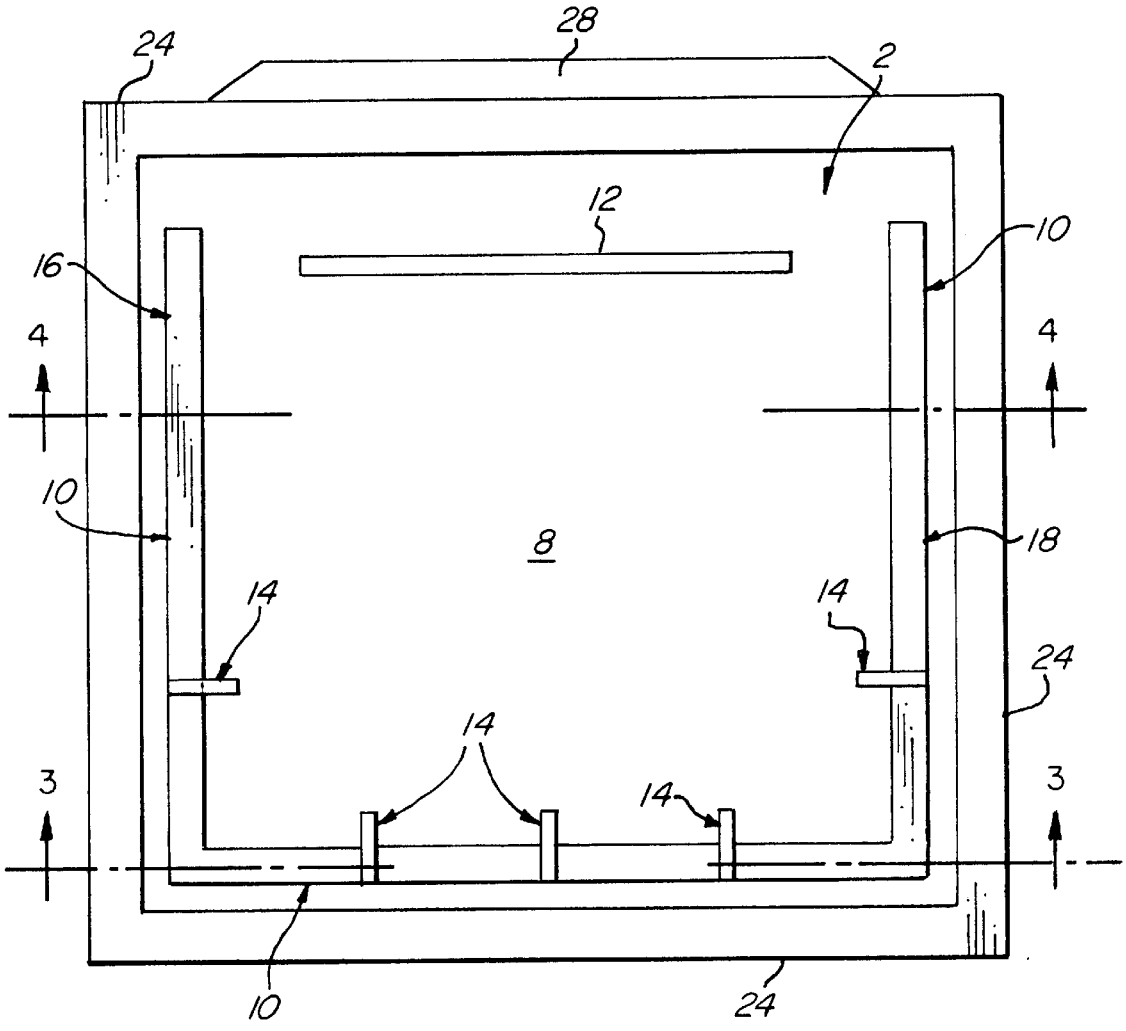
FIG. 1 is a front view of one embodiment of a mask in accordance with the present invention in a pull-apart storage structure.
Figure 2:
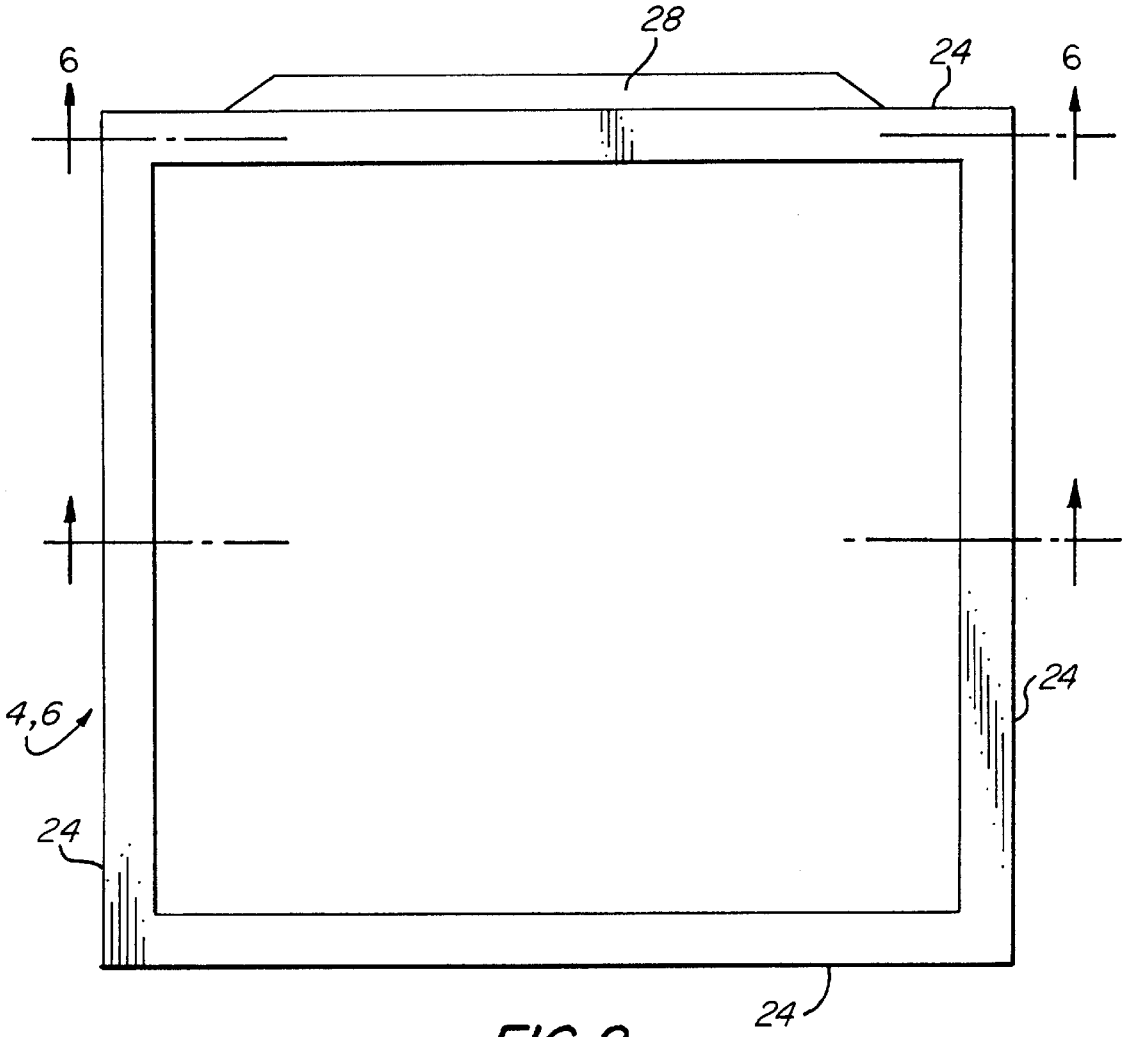
FIG. 2 is a front view of the sealing sheets of the pull-apart storage structure of FIG. 1.
Figure 6:
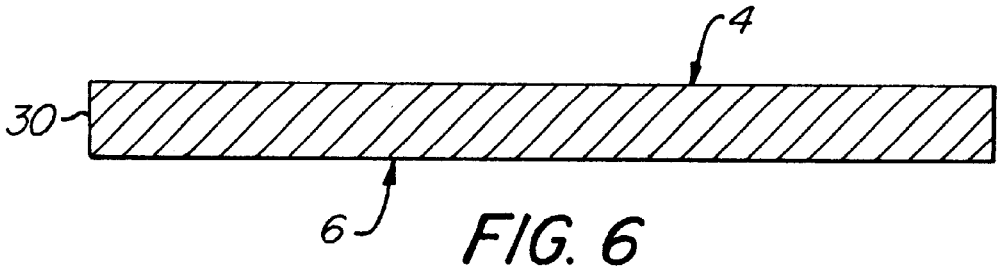
FIG. 6 is a section view, not drawn to scale, through Section 6—6 of FIG. 2.
Figure 5:
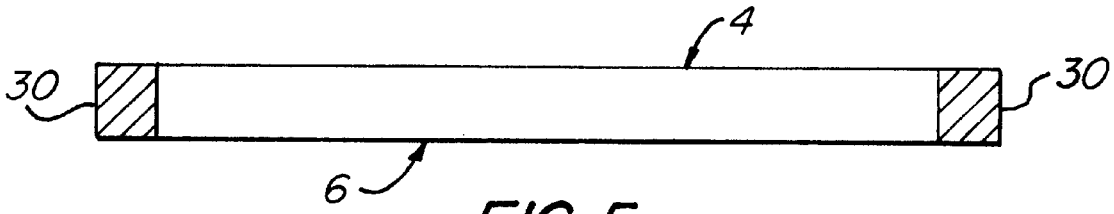
FIG. 5 is a section view, not drawn to scale, through Section 5—5 of FIG. 2.

Referring to FIGS. 1–6, a smoke mask in accordance with a first embodiment of the invention includes a mask portion 2, adapted to be worn by a user in the presence of smoke to reduce smoke inhalation, and first and second sealing sheets 4 and 6 which form a pull-apart storage structure to seal mask portion 2 in an air and moisture impermeable package prior to use.

In order to provide filtration of smoke particles, mask portion 2 includes a breathable mask 8, which may be either dry or moistened, and which has a filter efficiency of at least about 95%, meaning that at least about 95% of charge neutralized particles having an approximate size of 0.3 micrometers are removed from air flowing at a rate in a range of about 81 liters per minute to about 89 liters per minute, with a total filter load of at least about 200 milligrams of the particles. In another embodiment, mask 8 may be constructed of any single or multi-layered material, such as paper or a fibrous material, or for example, constructed of 100% cotton 10 oz. terry cloth material. Regardless of the particular material used, it should be breathable, and if it is to be moistened, it should be moisture absorptive and resistant to breakdown in the presence of moisture. Various other types of filters are shown, for example, in the U.S. patents discussed above, the contents of each of which are incorporated herein by reference.

A flexible strip 12, is attached to mask 8 by adhesive or the like to facilitate securing the mask to the bridge of the nose of the user, as described below. Flexible strip 12 is preferably a thin strip of metal, of the type known in the face mask field for this purpose. Alternatively, any appropriate flexible material may be used provided that it serves the function of securing mask 8 to the nose of the user. Flexible strip 12 may be secured to either surface of mask 8, or between the layers of mask 8 if a multi-layer structure is used.

Mask 8 is preferably rectangular-shaped, as shown in FIG. 1. Nonetheless, mask 8 may be constructed of any shape, provided that it is sized sufficiently to allow the user to breath when in use. For example, mask 8 may be more triangular shaped, which provides a more intuitive visual appearance to the user as to the proper way to attach the mask to the face.

If mask 8 is to be used moistened, it is stored in a pre-moistened condition, so that it will be immediately available for use by a user in a smoky condition. In this case, the mask is preferably moistened with water, either alone or in combination with other substances. Mask 8 may also be moistened with aloe, glycerin, and/or corn syrup, alone or in desired combinations. These substances are preferred to minimize the likelihood of face chapping when using the mask. Alternatively, various other substances, such as those disclosed in U.S. Pat. No. 5,322,060, may be utilized within the mask to neutralize the smoke, to filter particulates, or to serve any other useful function. However, it should be understood that mask 8 need not be moistened, and it is contemplated that mask 8 may be used and stored in a dry condition. All that is required is that mask 8 has a filter efficiency of at least about 95%.

Disposed along an outer peripheral edge and secured to mask 8 is an attachment lip 10. Attachment lip 10 is preferably constructed of a flexible sheet plastic material or the like, which is secured to mask 8 by an adhesive that will not degrade in the presence of moisture (particularly if a moistened mask 8 is employed), by stitching, or by other appropriate attachment means. Attachment lip 10 is coated on one side thereof with a pressure sensitive adhesive 20 of the type suitable for adhesion to human skin and releasable from the skin without injury. The adhesive is preferably hydrophobic in order to allow attachment to the skin even in the presence of moisture, from sweat or the like, that might be present on the skin in a smoke condition. In lieu of attachment lip 10, adhesive 20 may be located on mask 8 itself, either directly, or secured thereto on a sheet material, such as a two-sided tape. For example, one-side of a two-sided tape may be exposed and secured to the outer periphery of mask 8 during manufacture, preferably prior to moistening of the mask. The other side of the two-sided tape, which is coated with the hydrophobic pressure sensitive adhesive is exposed only during use of the mask, as discussed in detail below. Other alternatives include, for example, stitching a one-sided tape to mask 8, with the adhesive side of the tape only exposed during use, or attachment of two-sided tape to attachment lip 10.

Figure 7:
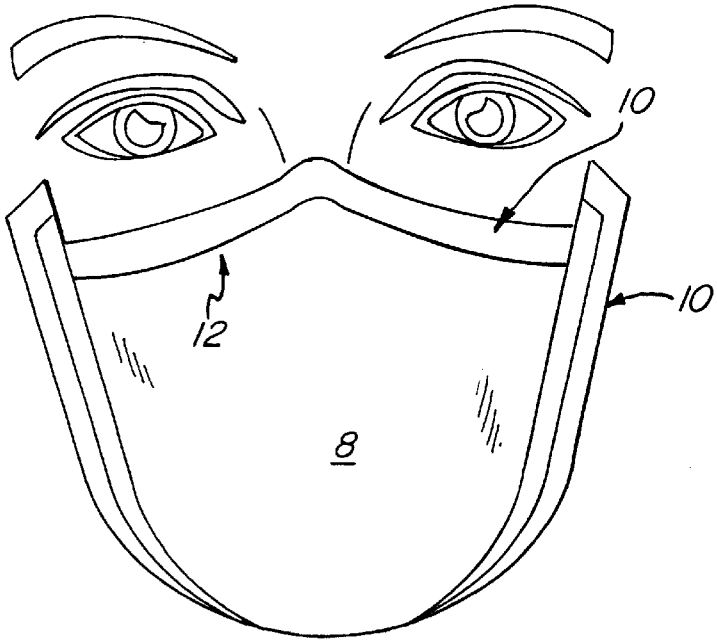
FIG. 7 is a front view of the mask of FIG. 1 attached to the face of a user.
Figure 8:
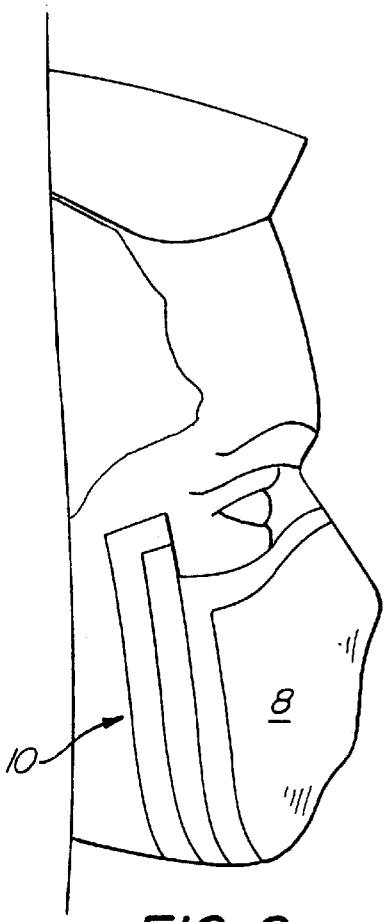
FIG. 8 is a side view of the mask of FIG. 1 attached to the face of a user.
Figure 9:
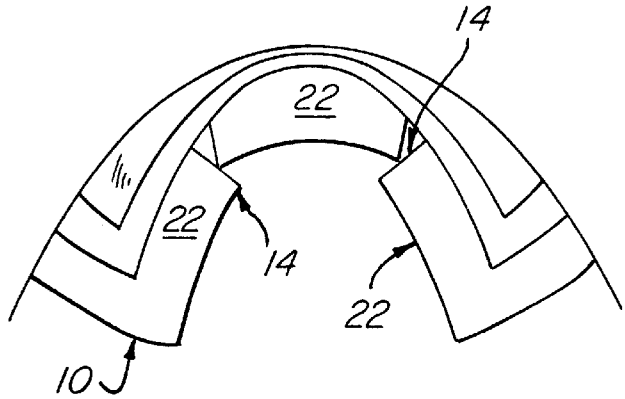
FIG. 9 is an underside view of the mask of FIG. 1 attached to the face of a user.
Figure 10:
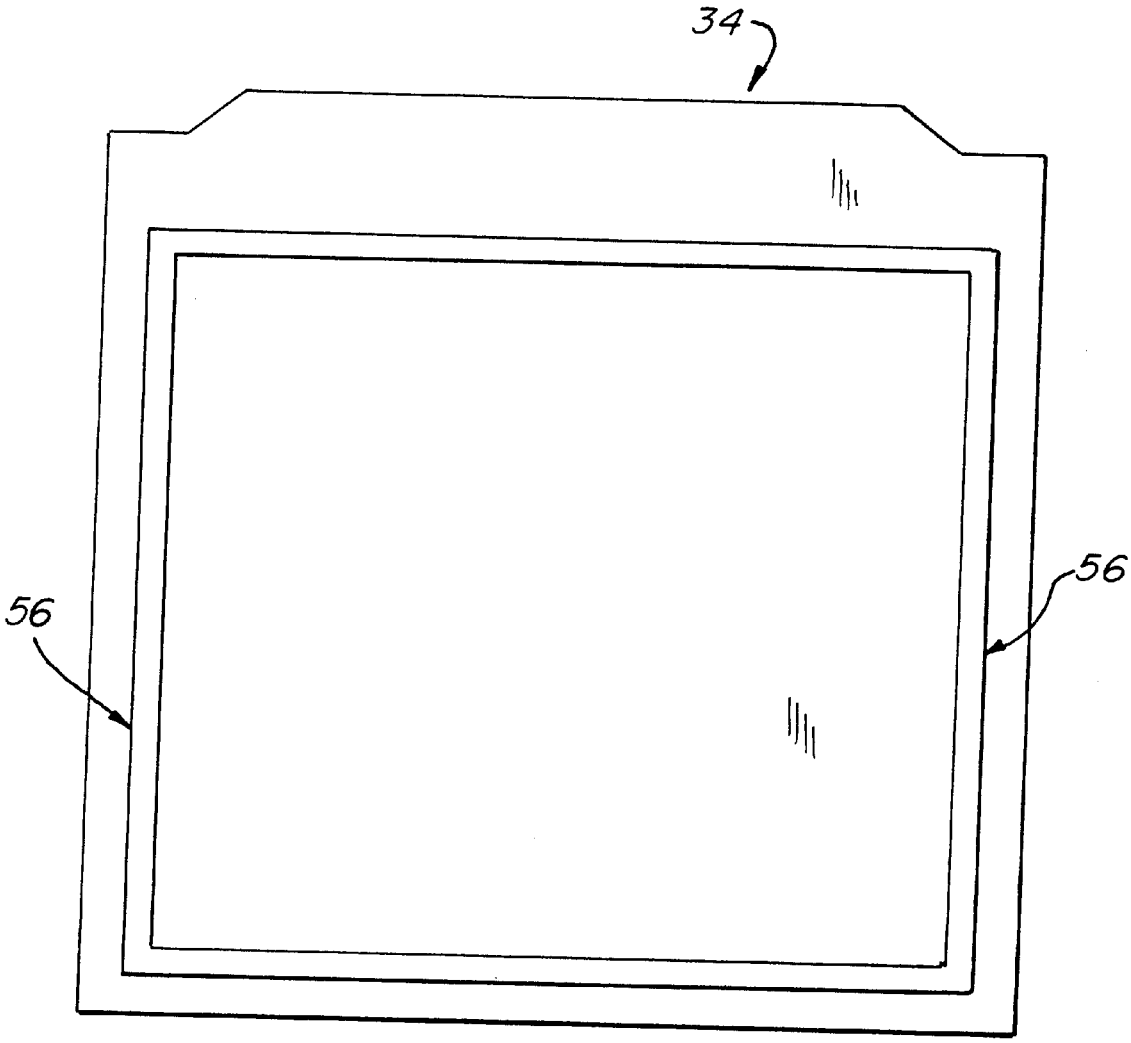
FIG. 10 is a front view of the front sealing sheet in an alternative embodiment of the invention.
Figure 11:
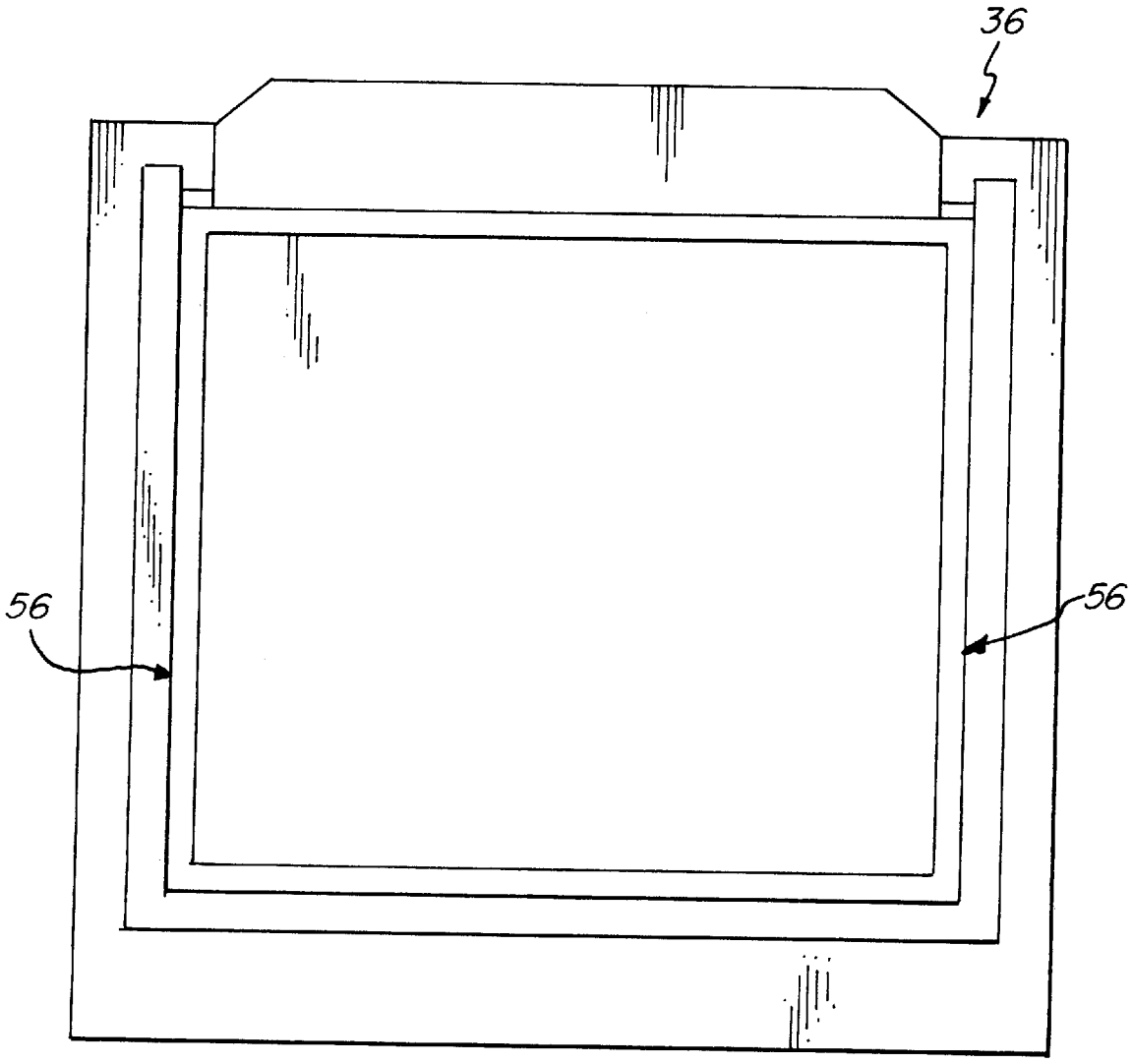
FIG. 11 is a front view of the rear sealing sheet in an alternative embodiment of the invention.
Figure 12:
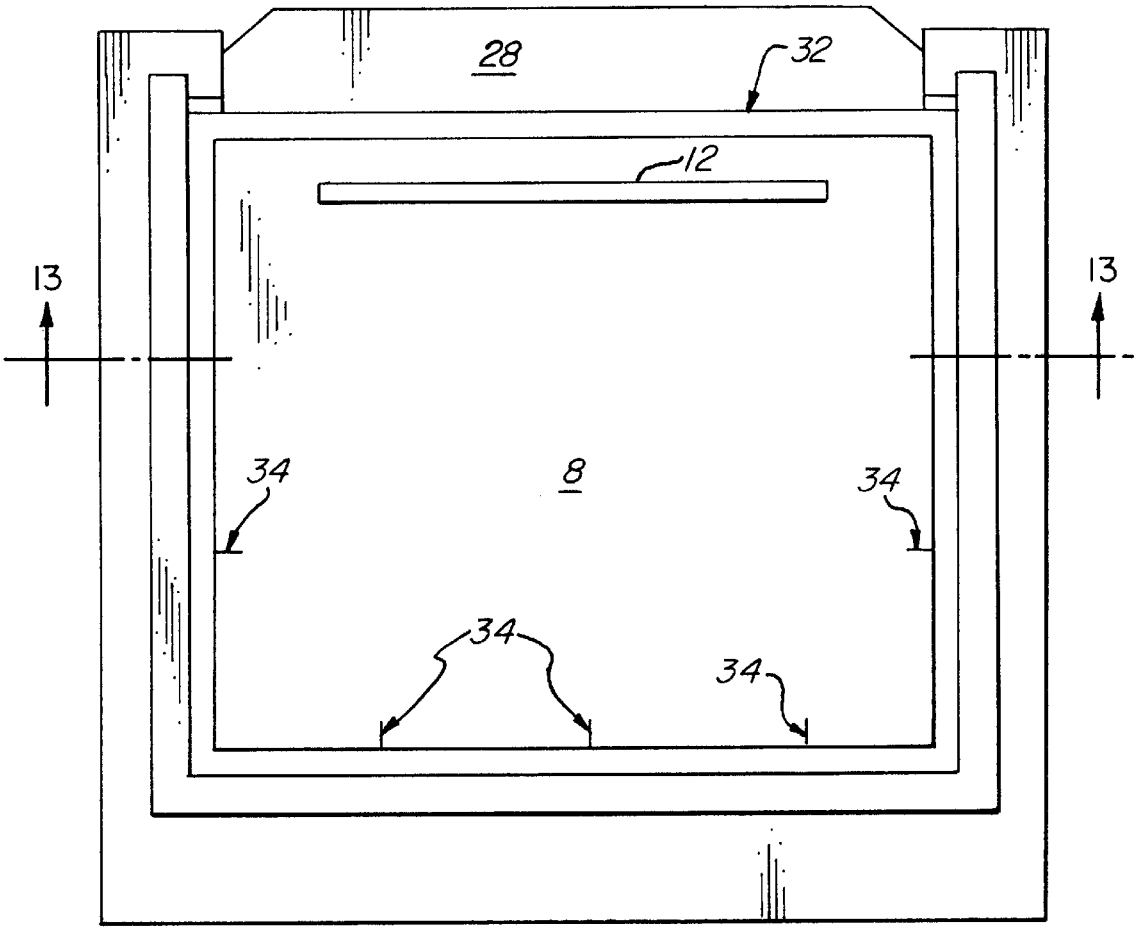
FIG. 12 is a front view of the mask of an alternative embodiment of the invention in the sealing structure for the mask.
Figure 13:
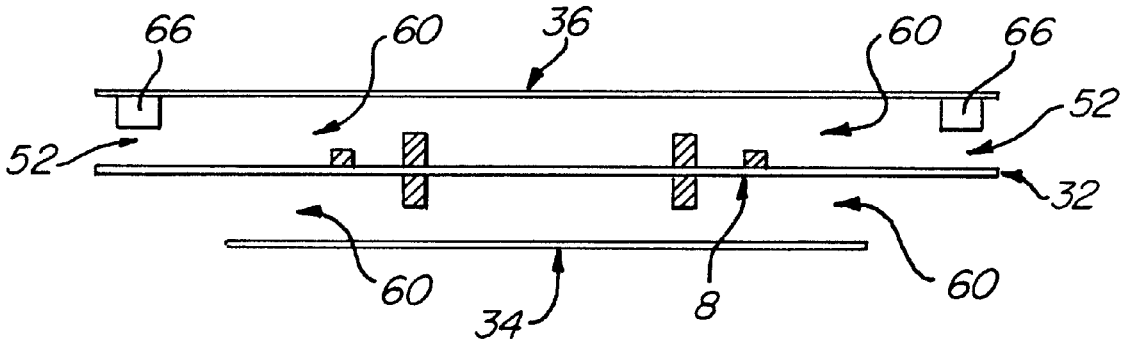
FIG. 13 is a section view, not drawn to scale, through Section 13—13 of FIG. 12.

Attachment lip 10 includes a number of slits 14 cut therein, as shown in FIG. 1, which may extend into mask 8 if desired. Slits 14 are provided in order to improve the fit of mask 8 on the face during use by preventing bunching of the mask due to the irregular facial features. Slits 14 permit the otherwise flat mask 8 to be fitted tightly to the face, as shown in FIGS. 7–9. During use, the adhesive on attachment lip 10 is exposed, as discussed below. The mask is applied to the face, with flexible strip 12 being bent to secure the mask portion to the bridge of the nose. Attachment lip 10 includes upstanding portions 16 and 18, which are pressed against the cheeks for adhesive 20 to attach thereto. Upstanding portions 16 and 18 include one or more slits 14 extending therethrough, which become slightly overlapped when the mask is applied to the cheeks to adjust to the curvature and contour of the face (not shown in FIGS. 7–9). Attachment lip 10 also includes a lateral portion 22, which is folded under the chin, and secured thereto by adhesive 20. In areas where bunching would normally occur, slits 14 are overlapped by the wearer to create a tight seal where attachment lip 10 is secured to the chin and cheeks. While flexible strip 12 provides a relatively tight fit of mask 8 to the bridge of the nose, if desired, attachment lip 10 may be extended laterally along the portion of the mask having flexible strip 12, thereby providing an adhesive attachment of the mask to the face along the entire periphery of the mask. If an attachment lip is not used, the slits may be cut in mask 8 itself.

Sealing sheets 4 and 6 together constitute a pull apart package for storing mask portion 2 until use. An outer peripheral edge 24 of each sealing sheet is sealingly attached to the outer peripheral edge of the other sealing sheet during manufacture. Mask 8 may be pre-moistened before manufacture so that it is stored in a wetted condition. However, as discussed above, it should be understood that mask 8 need not be moistened, and it is contemplated that mask 8 may be used and stored in a dry condition. When a moistened mask 8 is used, outer peripheral edge 24 of each sealing sheet is sealingly attached to the outer peripheral edge of the other sealing sheet during manufacture in such a manner as to create an air and water-tight cavity between the sheets, in which mask 8 is stored until use. Sealing sheets 4 and 6 may be sealed together on their outer peripheral edges 24 by any appropriate sealing means 30, including pressure-sensitive, heat activated, or other adhesive, hot-glue, sonic welding, etc., provided that the sheets may be pulled apart with moderate physical pressure, preferably so that the pull-apart structure may be opened by a child. Sealing sheets 4 and 6 are preferably constructed of a translucent plastic, although any appropriate material may be used.

Each of the sealing sheets 4 and 6 preferably includes a pull tab 28 that enables the sealing sheets to be pulled apart and separated for use of mask portion 2. Pull tabs 28 are preferably integrally constructed with sealing sheets 4 and 6 and are formed by extending the peripheral edges of sheets 4 and 6 somewhat beyond outer peripheral edge 24, at which the sealing sheets are attached to one another. It is foreseen that tabs 28 may be separately attached to sealing sheets 4 and 6, or that alternative structures to pull apart the sealing sheets, e.g., pull cords, may be used.

Figure 4:
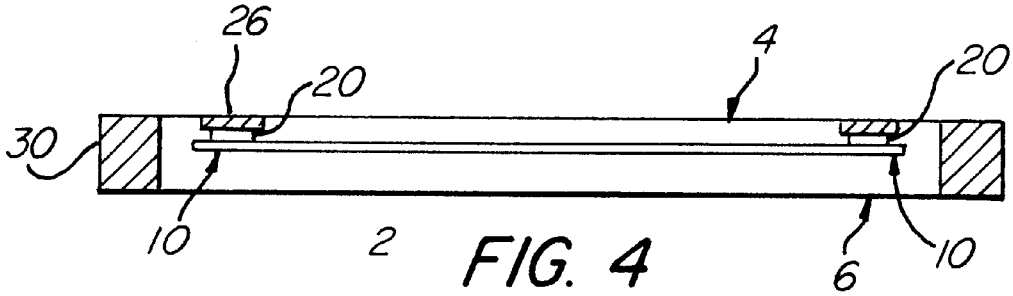
FIG. 4 is a section view, not drawn to scale, through Section 4—4 of FIG. 1.
Figure 3:
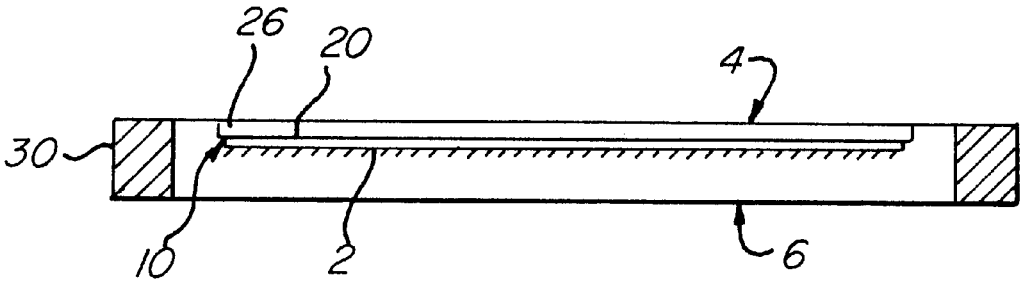
FIG. 3 is a section view, not drawn to scale, through Section 3—3 of FIG. 1.

One of the sealing sheets, in this case sealing sheet 4, is adapted to enable adhesive 20 to be exposed once the pull-apart structure is opened. In one embodiment of the invention, as shown in FIG. 4, adhesive 20 is covered by a release sheet covering 26, which is pulled from adhesive 20 to expose the adhesive. This type of release sheet covering is well known. In the invention, the side of the release sheet facing adhesive 20 is coated with, or constructed of, a material that releases from the adhesive when pulled therefrom. The other side of the release sheet covering is attached to sealing sheet 4 by any conventional means, such as with water-proof adhesive. After sealing sheets 4 and 6 are pulled apart, mask 8 will be left attached to sealing sheet 4 by release sheet covering 26. Mask 8 is then be pulled from sealing sheet 4, causing release sheet covering 26 to separate from adhesive 20, thereby exposing the adhesive and rendering the mask ready for use. It will be appreciated that the storage and release mechanism of the invention may be utilized with a mask of any size or shape, whether or not the mask includes slits 14.

Alternatively, it is foreseen that sealing sheet 4 may itself be used to cover adhesive 20 until use. In this embodiment, sealing sheet 4 may be covered on the portion thereof in contact with adhesive 20 by a release material, and pressed against adhesive 20 during manufacture to seal the adhesive. It will be appreciated that any appropriate material that releases from adhesive 20 may be used to coat sealing sheet 4, or sealing sheet 4 may be constructed in its entirety of a release sheet, provided that sealing sheet 4 is still capable of being attached to sealing sheet 6 to form the pull-apart structure.

In an alternative embodiment of the invention, as shown in FIGS. 10–14, the smoke mask includes a mask portion 32 and front and rear sealing sheets, 34 and 36 respectively, which form a pull-apart storage structure to seal mask portion 2 in an air and moisture impermeable package prior to use. In this embodiment, sealing sheets 34 and 36 seal to mask portion 32 to form the pull-apart structure, rather than sealing to each other as in the prior embodiment. Mask 32 is similar to the mask of the prior embodiment with the exceptions noted below, and like reference numerals are used to show corresponding structures. As in the prior embodiment, mask 8 may be stored in a moistened condition, so that it will be immediately available for use by a user in a smoky condition. However, also as in the prior embodiment, mask 8 need not be moistened, and it is contemplated that mask 8 may be used and stored in a dry condition. All that is required is that mask 8 has a filter efficiency of at least about 95%.

Figure 14:
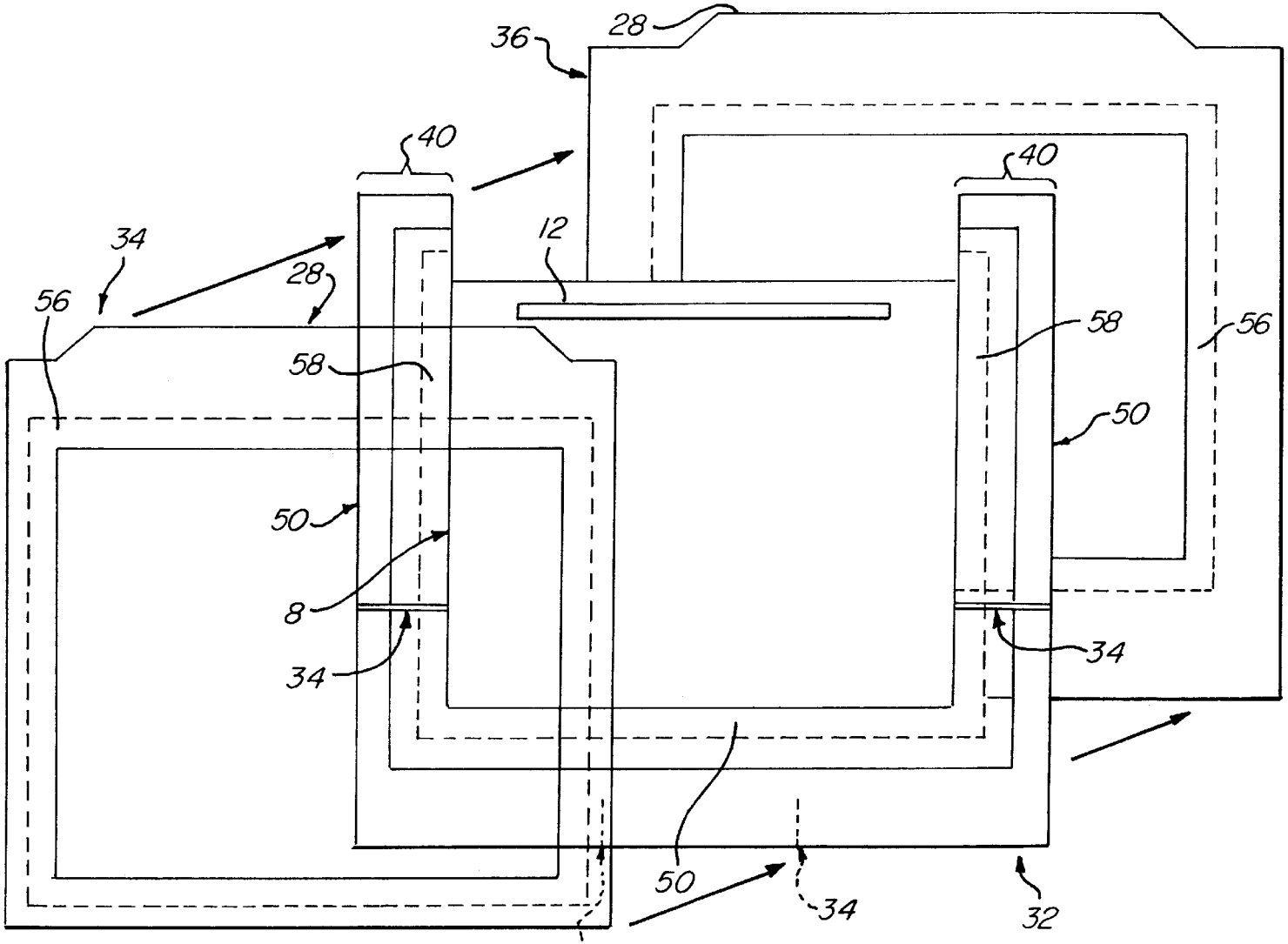
FIG. 14 is an exploded view of the alternative embodiment of the mask of the invention.

Secured to mask 8 is an attachment lip 40, which includes those portions of mask 32 extending peripherally outward from mask 8, as shown in FIG. 14. Attachment lip 40 is preferably constructed of a flexible sheet plastic material, which is secured to mask 8 by an adhesive that will not degrade in the presence of moisture, by stitching, or by other appropriate attachment means. An outer portion 50 of attachment lip 40 is coated on the side thereof facing rear sealing sheet 36 with a pressure sensitive adhesive 52 of the type suitable for adhesion to human skin and releasable from the skin without injury. Adhesive 50 is covered by sealing sheet 36, and exposed only when sealing sheet 36 is removed just prior to use.

Attachment lip 40 includes a number of slits 34 cut therein, as in the prior embodiment, to improve the fit of mask 8 on the face during use. Use of mask 8 is the same as in the prior embodiment, it being noted that outer portion 50 in this embodiment extends further up the cheeks than in the prior embodiment.

Sealing sheets 34 and 36 together constitute a pull apart package for storing mask portion 32 until use. Each of the sealing sheets 34 and 36 includes a sealing area 56 which includes an adhesive on the side thereof facing mask portion 32. Sealing area 56 of each sealing sheet is sealingly attached to a corresponding sealing area 58 on mask portion 32 during manufacture to create an air and water-tight cavity between the sheets, in which mask 8 is stored until use. Along a portion of mask 8 above flexible strip 12 over which peripheral lip 40 does not extend, sealing areas 56 of the sealing sheets seal to each other to complete the air and watertight seal of mask portion 32. If desired, peripheral lip 40 may be extended completely around mask 8 to eliminate the sealing of sealing sheets 34 and 36 to each other. Sealing sheets 34 and 36 are sealed to mask portion 32 and to each other by any appropriate sealing means 60, including pressure-sensitive, heat activated, or other adhesive, hot-glue, sonic welding, etc., Sealing sheets 34 and 36 are preferably constructed of a translucent plastic. Each of the sealing sheets 34 and 36 preferably includes a pull tab 28 that enables the sealing sheets to be pulled apart and separated for use of mask portion 32.

One of the sealing sheets, in this case rear sealing sheet 36, is adapted to enable adhesive 52 to be exposed once the pull-apart structure is opened. Adhesive 52 is covered by a release sheet covering 66, which is pulled from adhesive 52 to expose the adhesive. The side of the release sheet facing adhesive 52 is coated with, or constructed of, a material that releases from the adhesive when pulled therefrom. The other side of the release sheet covering 66 is attached to sealing sheet 36 by any conventional means, such as with adhesive. When sealing sheets 34 and 36 are pulled apart, mask 8 will be pulled from sealing sheet 36, causing release sheet covering 66 to separate from adhesive 52, thereby exposing the adhesive and rendering the mask ready for use. It is foreseen that sealing sheet 36 may itself be used to cover adhesive 52 until use by covering the portion thereof in contact with adhesive 52 with a release material.

FIGS. 15–18 shown an alternative storage structure 100 for mask 32. Storage structure 100 is generally a conventional blister-pack storage structure consisting of a backing 102 and a cover portion 104. Backing 102 is preferably constructed of a cardboard or other material that is covered in printed material associated with mask 32. On the portion of backing 102 facing mask portion 32, backing 102 is preferably covered, when a moistened mask is employed, with a film of plastic or other waterproof material to prevent degradation of backing 102 from the moist environment in which mask 32 is stored, and to keep storage structure 100 water impermeable.

Figure 15:
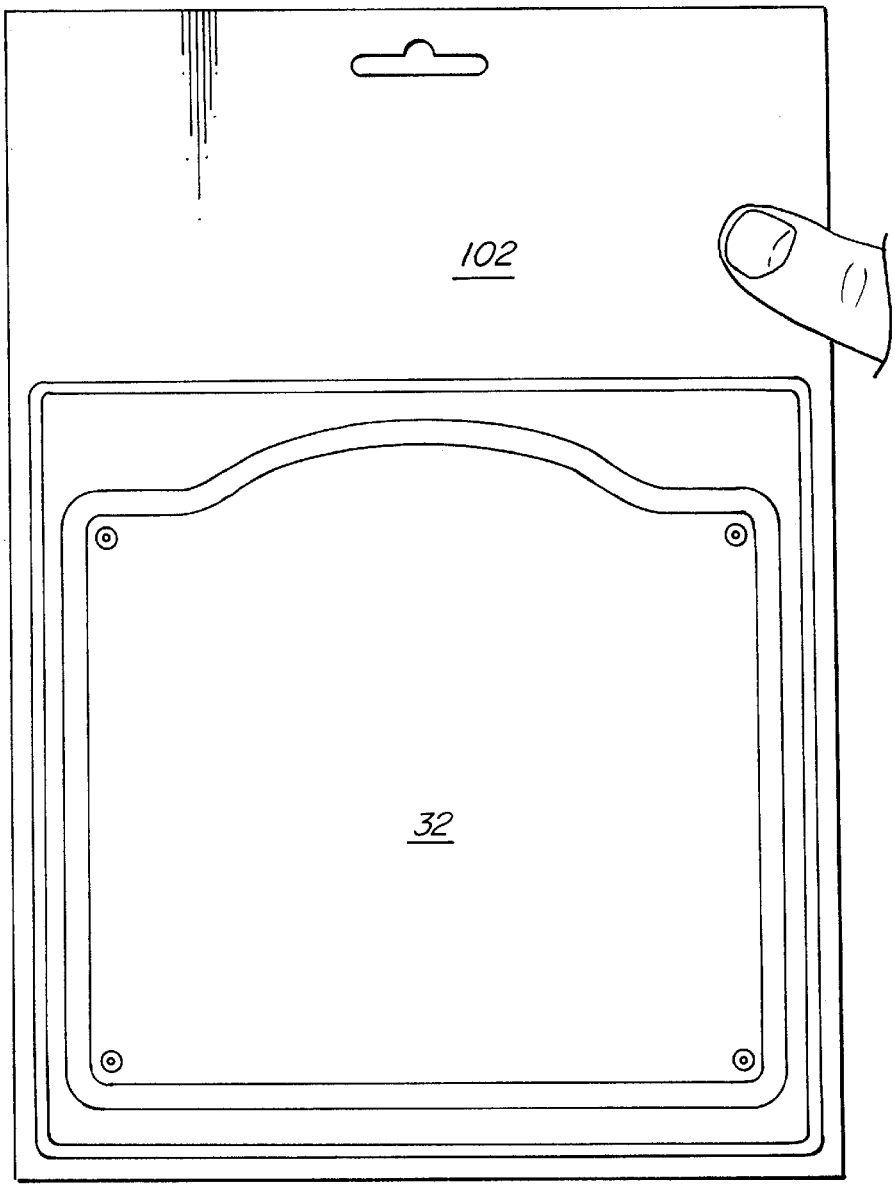
FIG. 15 is a front view of a blister-pack storage structure for a mask of the invention.
Figure 16:
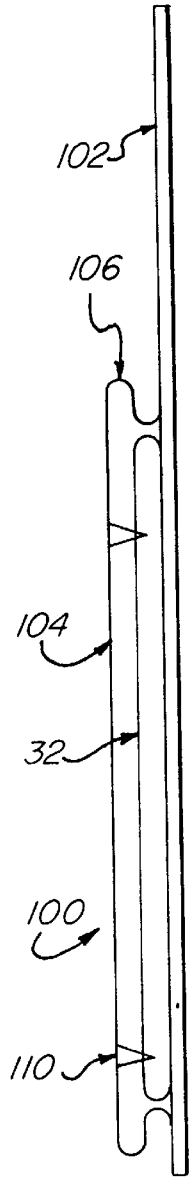
FIG. 16 is a side view of the storage structure shown in FIG. 15.
Figure 17:
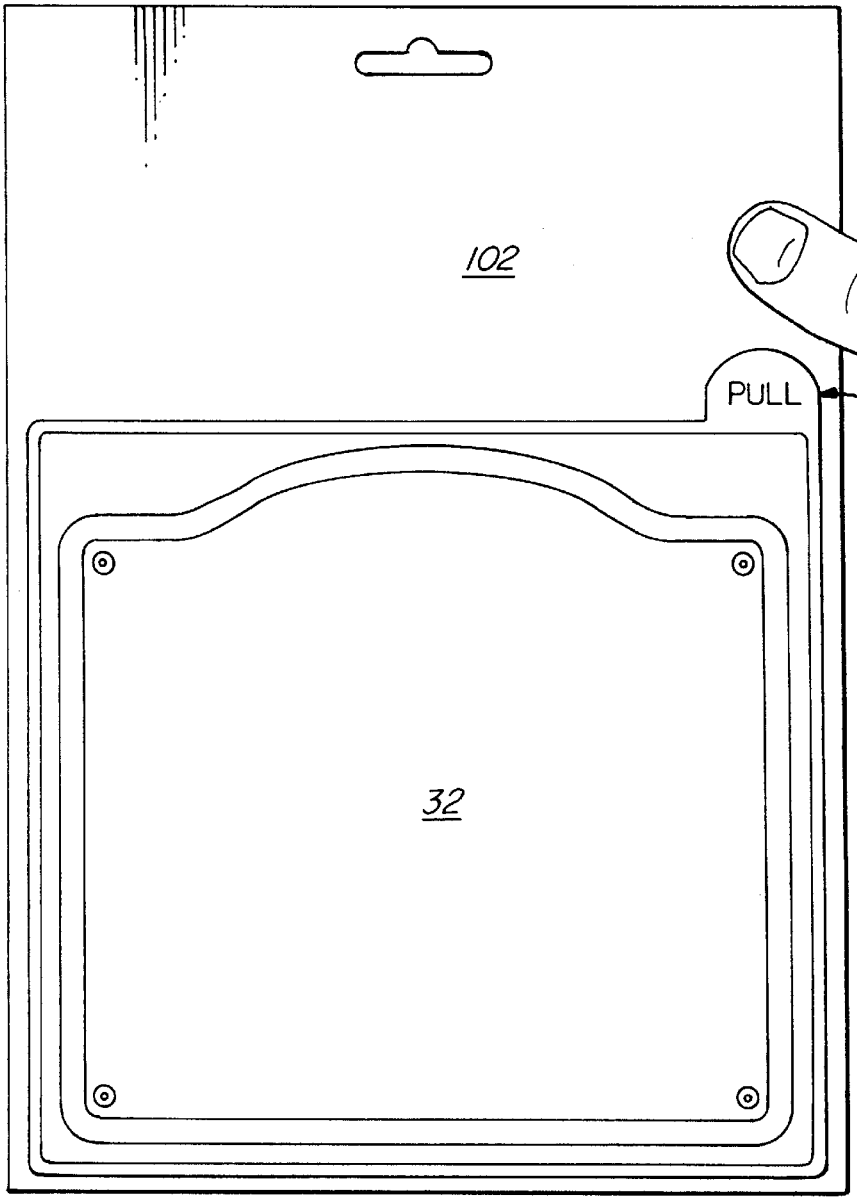
FIG. 17 is a front view of an alternative blister-like storage for the mask of the invention.
Figure 18:
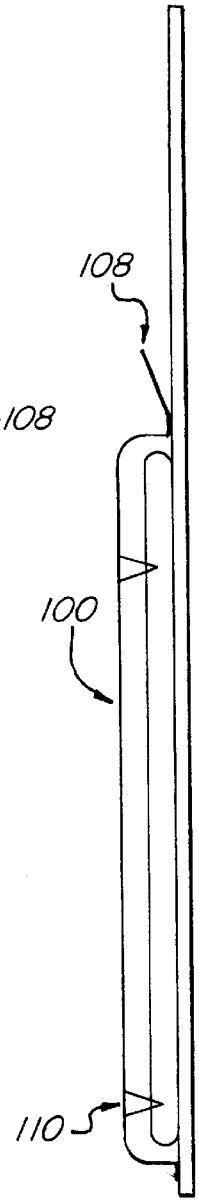
FIG. 18 is a side view of the storage structure shown in FIG. 17.

Cover 104 is preferably constructed of a vacuum formed plastic or other water impermeable material, and is preferably translucent to enable mask 32 to be seen from the exterior of storage structure 100. Cover 104 defines an interior cavity in which mask 32 is stored until use. Cover 104 is secured to backing 102 using any conventional water-proof adhesive that allows mask 32 to remain in a water-tight environment and that would allow the storage structure to be opened without undue manipulation in the event mask 32 is needed for use. As shown in FIGS. 15 and 16, cover 104 preferably includes a lip portion 106 running along at least one edge thereof, preferably along the entire edge. Lip portion 106 is preferably sized so that the lip may be grasped by a user and pulled away from backing 102 to rapidly open storage structure 100 in an emergency. Lip portion 106 is preferably integrally formed with cover 104. In an alternative embodiment, as shown in FIGS. 17 and 18, a tab 108 is attached to cover 104, preferably by being integrally formed therewith. To open storage structure 100, a user, while holding backing 102, pulls tab 108 with sufficient force to overcome the adhesive bond between cover 104 and backing 102, or to enable the plastic coating on backing 102 to tear away from or separate from the backing. It is foreseen that other opening mechanisms may be utilized in connection with storage structure 100, and that other alternative storage structures for mask 32 may be used as well.

On the side thereof facing backing 102, an outer peripheral edge of mask 32 is coated with an adhesive of the type described above to enable the mask to be applied to the face of a user. Backing 102 preferably includes a release tape on the surface thereof facing mask 32 so that the mask is attached to the release tape on backing 102. In use, once storage structure 100 is opened, mask 32 remains attached to backing 102, and may be used by pulling mask 32 off of the release tape, thereby exposing the adhesive on mask 32. It is foreseen that mask 32 may be mounted to any wall of the cavity formed by cover 104 and backing 102, so that, for example, mask 32 may remain attached to cover 104 when structure 100 is opened. If desired, protuberances 110 may be included on cover 104. Protuberances 110, which may be mounted to or integral with cover 104, apply pressure to mask 32 to maintain the adhesive on mask 32 in contact with the release tape on backing 102 in order to preserve the adherence of the adhesive.

Referring to FIGS. 19–23, in an alternative embodiment of the invention, fire and smoke escape mask structure 302 includes a breathable mask 304, which is attached to the face of a user to filter smoke, and an eye protector 306, which protects the eyes of the user while allowing the user to see, and which also attaches to the face of the user to prevent smoke infiltration. Breathable mask 304 is attached to eye protector 306 so that the mask and eye protector are attached to the face of the user in a one-piece structure.

In order to provide filtration of smoke particles, breathable mask 304 includes a filtration area 308 adjacent to the mouth and nose of the user, and an attachment area 310 along the bottom and side peripheral edges thereof. Breathable mask 304 may be either dry or moistened, and is made of a material which has a filter efficiency of at least about 95%, meaning that at least about 95% of charge neutralized particles having an approximate size of 0.3 micrometers are removed from air flowing at a rate in a range of about 81 liters per minute to about 89 liters per minute, with a total filter load of at least about 200 milligrams of the particles. In some embodiments, mask 8 may be constructed of any single or multi-layered material, such as paper or a fibrous material, or for example, constructed of 100% cotton 10 oz. terry cloth material. Regardless of the particular material used, it should be breathable, and if it is to be moistened, it should be moisture absorptive and resistant to breakdown in the presence of moisture. Filtration area 308 and attachment area 310 may be constructed of the same or different materials. Various other types of filters are shown, for example, in the U.S. patents discussed above, the contents of each of which are incorporated herein by reference.

Figure 19:
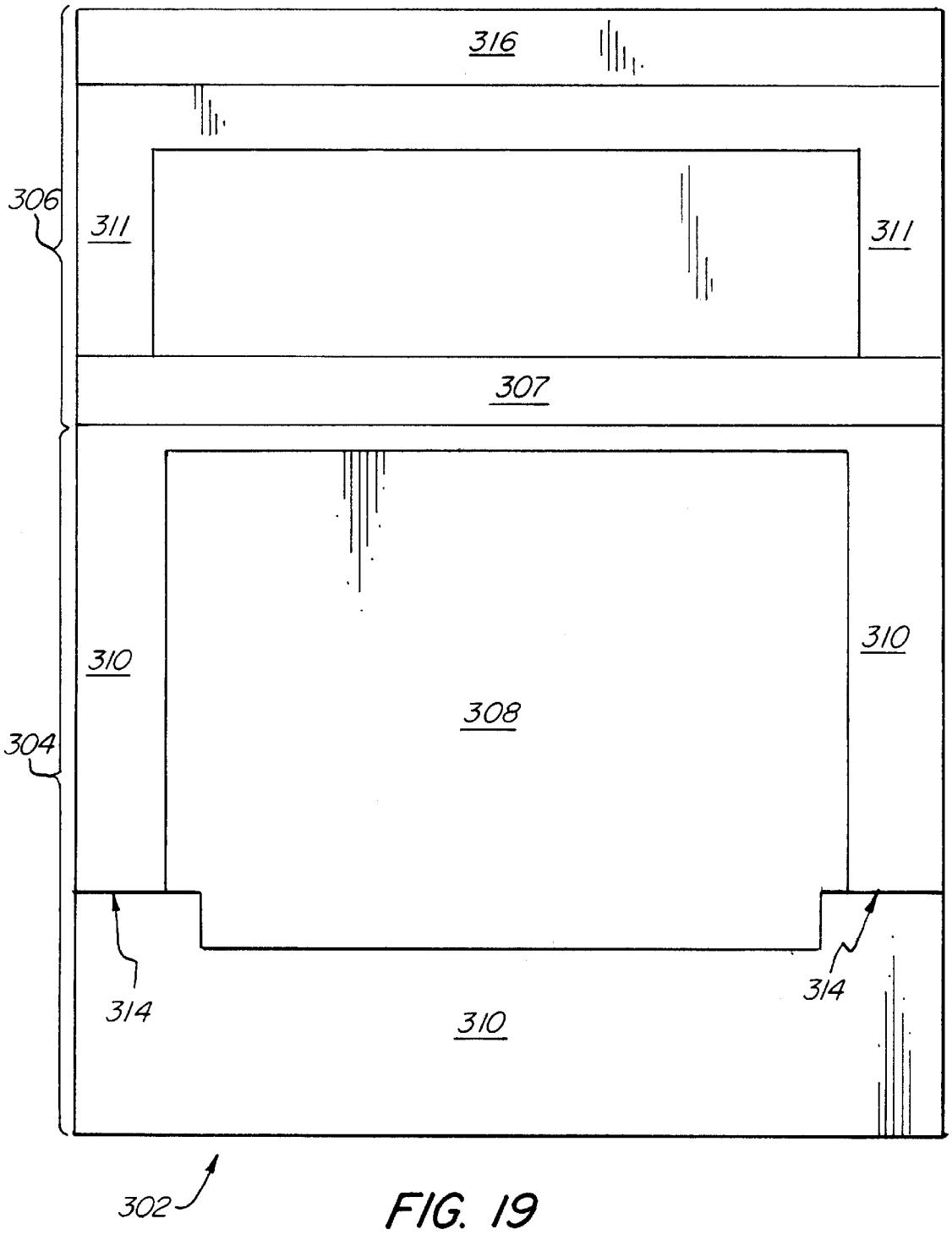
FIG. 19 is a front view of a further embodiment of a pull-apart mask of the invention.
Figure 20:
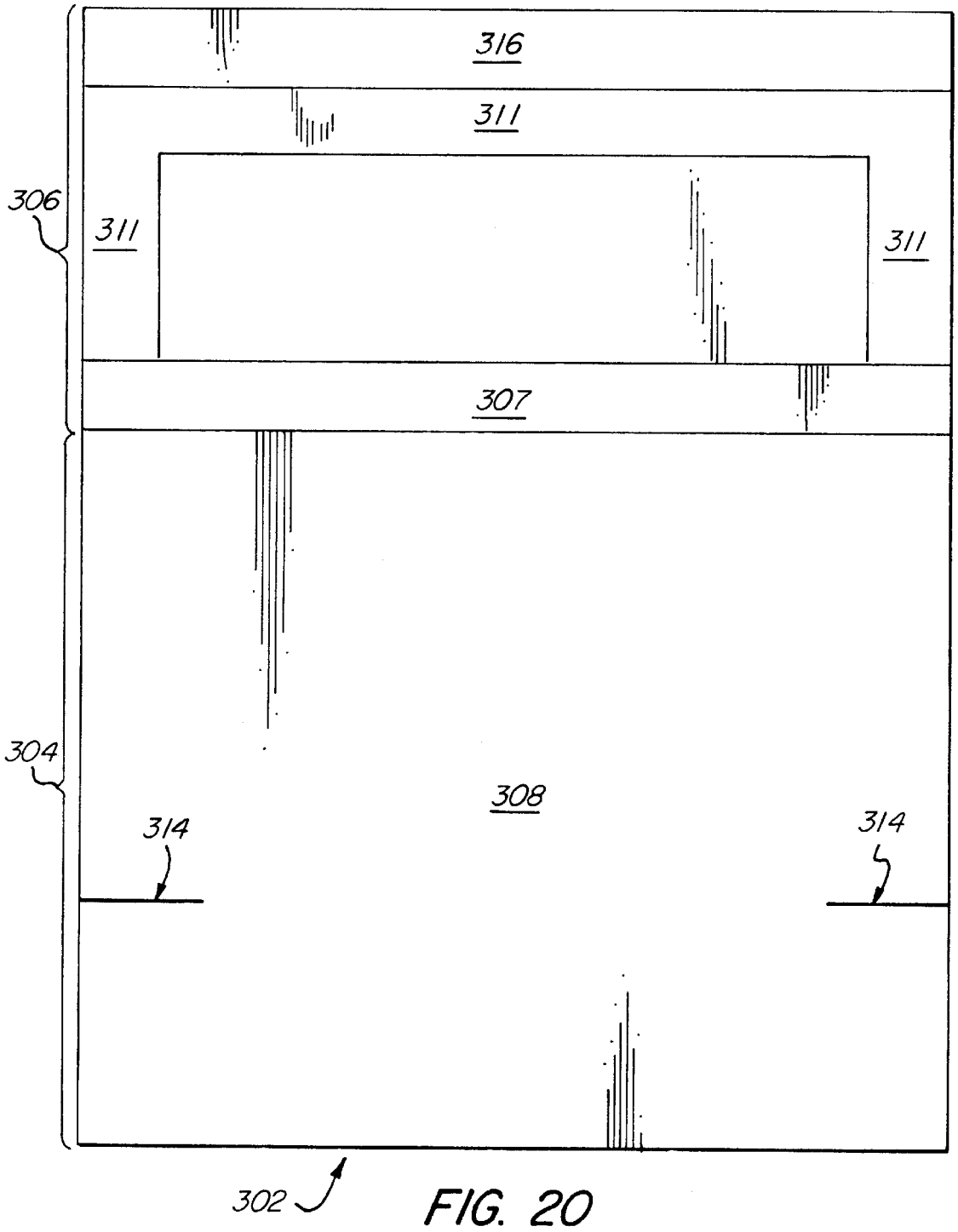
FIG. 20 is a rear view of the embodiment shown in FIG. 19.
Figure 21:
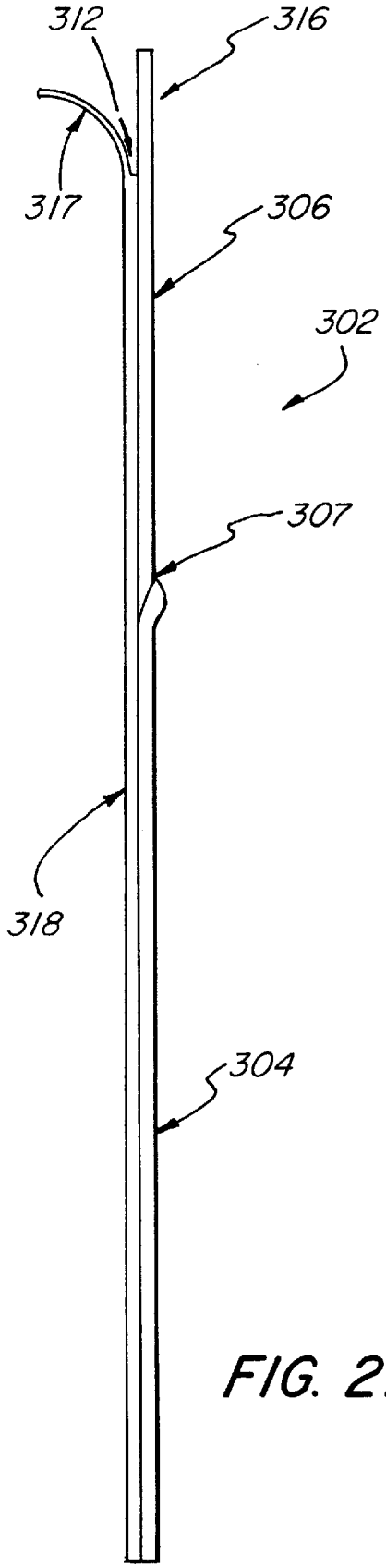
FIG. 21 is a side view of the embodiment shown in FIG. 19.

Breathable mask 304 is preferably generally rectangular-shaped, as shown in FIGS. 19 and 20. Nonetheless, breathable mask 304 may be constructed of any shape, provided that it is sized sufficiently to allow the user to breath when in use. For example, the lower portion of breathable mask 304 may be more triangular shaped, which provides a more intuitive visual appearance to the user as to the proper way to attach the mask to the face. If desired, breathable mask 304 may be sized to cover the entire face of the user, with an aperture cutout near the eyes of the user, which aperture is then covered by eye protector 306.

A lower edge 307 of eye protector 306 is attached to breathable mask 304, preferably by means of a waterproof adhesive, although any appropriate attachment means may be used, e.g., stitching or sonic welding (if permitted by the selected materials). Eye protector 306 may be constructed of any transparent material that would enable to user to see while using the mask, but is preferably constructed of a distortion-free optically clear PET film, which will allow mask 302 to be rolled without interference. Alternatively, eye protector 306 may be plastic goggles, preferably having a low profile so that mask 302 may be rolled without undue difficulty, or an anti-fogging film such as 9962 Anti-Fog Film available from 3M Corporation. Alternatively, any appropriate transparent eye-protection may be used.

Disposed along the top and side edges of eye protector 306 on the same surface as attachment area 310 is an attachment area 311. Attachment areas 310 and 311 of mask 302 are preferably coated with a pressure sensitive adhesive 312 of the type suitable for adhesion to human skin and releasable from the skin without injury. Adhesives of this type are available from Avery Dennison Corporation. The adhesive is preferably hydrophobic in order to allow attachment to the skin even in the presence of moisture, from sweat or the like, that might be present on the skin in a smoke condition.

A release sheet 318, in combination with mask 302, forms a pull apart structure to prevent exposure of adhesive 312 until use. An outer peripheral edge of release sheet 318 is attached to the attachment areas 310 and 311 of mask 302 to cover the adhesive until use. Release sheet 318 is adapted to enable adhesive 312 to be exposed once the pull-apart structure is opened. In use, release sheet 318 is pulled from adhesive 312 to expose the adhesive and to enable the mask for attachment to the face of the user.

An outer peripheral edge of breathable filter 304 preferably includes a number of slits 314 cut therein, as shown in FIG. 19. Slits 314 are provided in order to improve the fit of mask 302 on the face during use by preventing bunching of the mask due to the irregular facial features. Slits 314 are preferably positioned toward the chin area of the user, i.e., on the lower portion of mounting portion 304, although it is foreseen that slits 314 may be included on any portion of attachment areas 310 and 311 in order to facilitate more secure attachment of mask 302 to the face of the user. During use, once the adhesive on attachment areas 310 and 311 is exposed, the mask is applied to the face with the adhesive areas securing the mask to the face. On those portion of the mask at which bunching would normally occur, slits 314 are overlapped by the wearer to create a tight seal where attachment area 310 is secured to the chin and cheeks.

Mask 302 is constructed by applying adhesive to attachment areas 310 and 311. Thereafter, a release sheet 318, which is preferably sized and shaped to cover mask 302, is applied to mask 302 and releasably attached to attachment areas 310 and 311 by the adhesive. Release sheet 318 is preferably constructed of a translucent material such as PET, although any appropriate material may be used.

Eye protector 304 preferably includes a tab area 316 on the top peripheral edge thereof that is not coated with adhesive. Tab area 316 and a corresponding tab area 317 on release sheet 318 provide gripping areas for the user to pull apart release sheet 318 from mask 302 during use of the mask. Tab areas 316 and 317 may extend somewhat from the peripheral edges of mask 302 to facilitate easier gripping.

As discussed in connection with the prior embodiments, if mask 302 is to be moistened, it is stored in a pre-moistened condition, so that it will be immediately available for use by a user in a smoky condition. When such is the case, the mask is preferably moistened with water, either alone or in combination with other substances. However, since mask 302 covers the eyes of the user, the substances used to moisten the mask should preferably not include eye-irritating substances.

Figure 22:
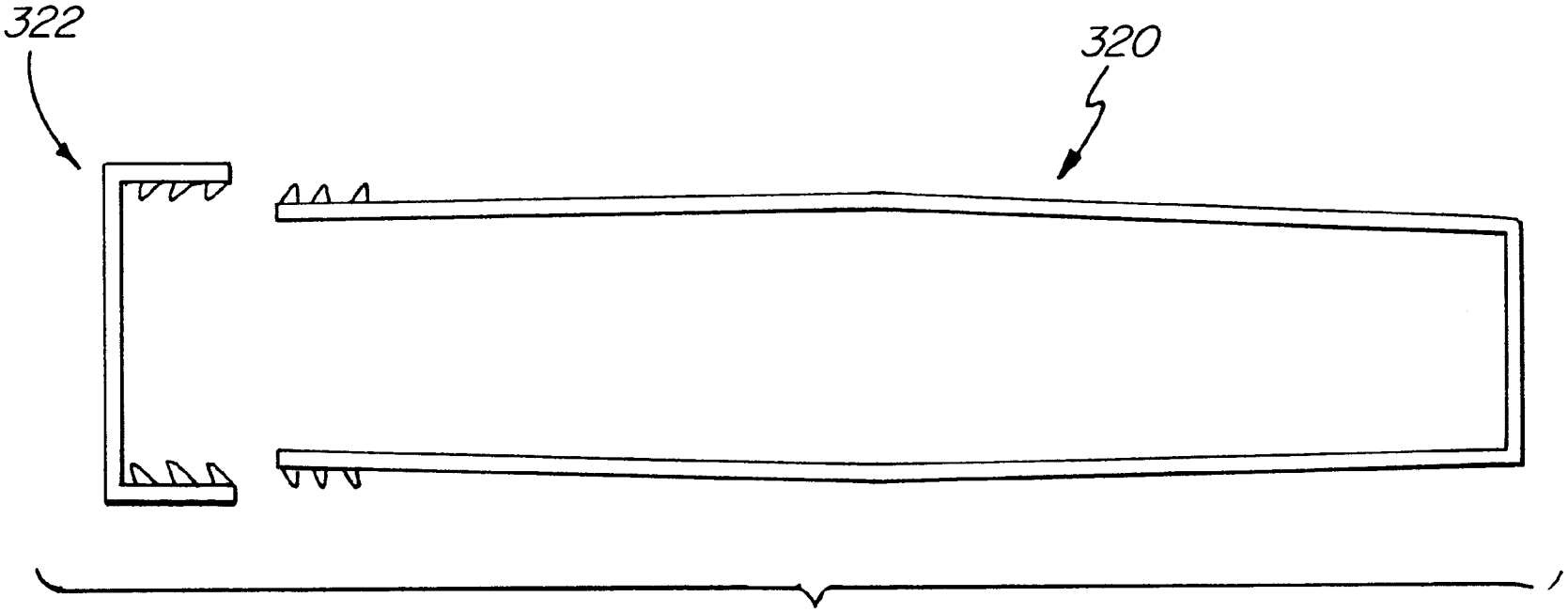
FIG. 22 is a side view of a canister storage structure for a pull-apart mask of the invention.
Figure 23C:
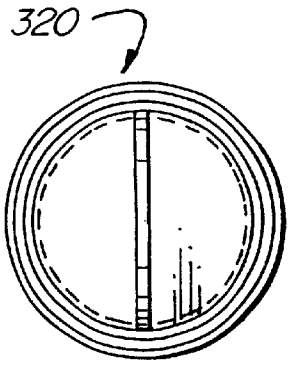
FIGS. 23A–23C are side, sectional and end views respectively view of an alternative canister storage structure for a pull-apart mask of the invention.
Figure 23A:
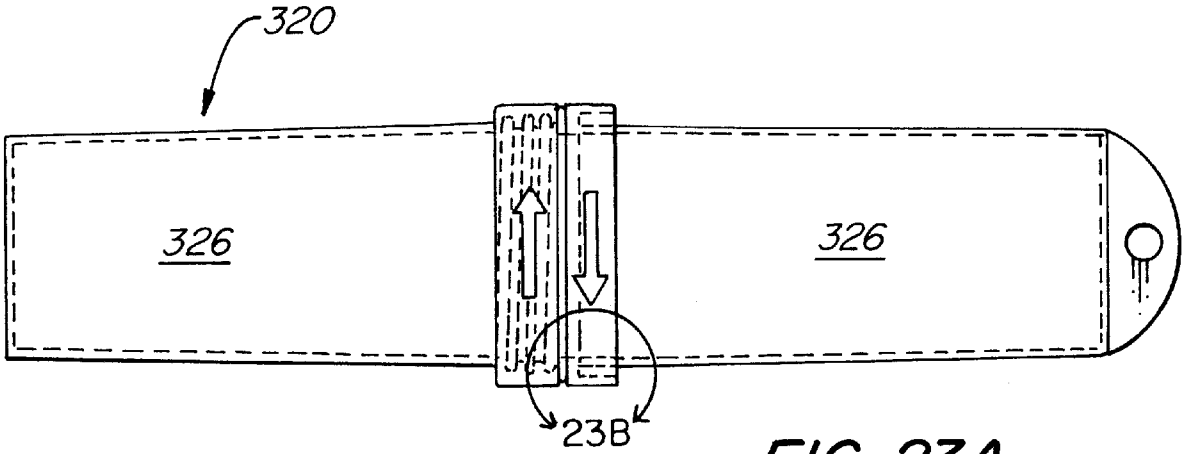
Figure 23B:
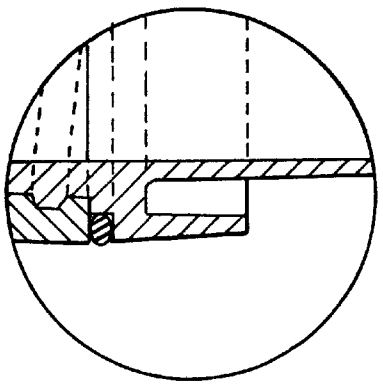

As shown in FIG. 22, if mask 302 is to be moistened, it is preferably stored in a wetted condition in a watertight canister 320. Canister 320 is preferably constructed of a lightweight plastic material, although any appropriate waterproof material may be used. Canister 320 is generally cylindrical in shape, and includes an open end into which mask 302 is rolled and inserted, and a closed end. An end cap 322, preferably constructed of the same material as canister 320, includes threads that allow end cap 322 to be threadingly engaged to the open end of canister 320. Cap 322 must form a watertight seal with cap 320, and it is foreseen that sealing means, such as O-rings, Teflon tape, or any other known method of creating a waterproof seal may be used to seal cap 322 on canister 320. It is also foreseen that other sealing methods beside threads may be used, e.g., a plastic cap of the type commonly used on milk containers in which a tab is pulled around the cap to remove the tab and release the cover, or a pull-tab on the end face of the canister, either in metal or plastic, that is used to permanently remove the entire end-face of the canister, and that is commonly used in potato-chip canisters. Alternatively, any other method of sealing canister 320 may be used. Moreover, as shown in FIG. 23, it is foreseen that canister 320 may be comprised of threaded halves 326, so that the halves are threaded together to seal canister 320, as opposed to using an end cap.

In use, canister 320 is threaded open to release the hermetic seal, and mask 302 is removed. Release sheet 318 is then removed from mask 302 to expose the adhesive, and the mask is applied to the face.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A smoke mask which comprises:

a mask structure comprising a generally planar breathing filter sized to cover the nose and mouth of a user, and a transparent eye shield in attachment with the breathing filter, the mask structure having a peripheral edge surrounding both the breathing filter and the eye shield, the breathing filter having a filter efficiency of at least about 95%, wherein the breathing filter removes at least about 95% of charge neutralized particles having an approximate size of 0.3 micrometers from air flowing at a rate in a range of about 81 liters per minute to about 89 liters per minute, with a total filter load of at least about 200 milligrams of the particles;

pressure sensitive adhesive on the peripheral edge of the mask structure on one surface thereof for securing the mask structure to the face of the user covering the mouth, nose and eyes of the user in a substantially airtight manner; and a release sheet covering the adhesive, wherein the adhesive is exposed upon removal of the release sheet.

2. The smoke mask according to claim 1 further comprising at least one slit in the peripheral edge of the mask structure for enabling the mask structure to adapt to the contour of the face of the user.

3. The smoke mask according to claim 1 wherein the mask structure or release sheet comprises at least one pull-apart tab for being grasped by a user.

4. The smoke mask according to claim 1 wherein the eye shield is selected from the group consisting of plastic film or goggles.

5. The smoke mask according to claim 1 wherein the breathing filter is attached directly to the eye shield by means of sonic welding, heat sealing, adhesive or stitching.

6. The smoke mask according to claim 1 wherein the release sheet is constructed of a plastic film.

7. The smoke mask according to claim 1 wherein the release sheet is translucent.

8. The smoke mask according to claim 1 wherein the breathing filter comprises a dry material.

9. The smoke mask according to claim 1 wherein the breathing filter comprises a moistened material.

10. The smoke mask according to claim 9 in combination with a waterproof storage structure, whereby the smoke mask is stored within the waterproof storage structure in a wetted condition.

11. The smoke mask according to claim 10 wherein the storage structure is a canister.

12. The smoke mask according to claim 11 wherein the canister is sealed by means of a pull-off cover or a threaded cover.

13. The smoke mask according to claim 11 wherein the canister comprises threaded halves.

14. In combination:

a smoke mask structure comprising a breathing filter having a peripheral edge surrounding the entire mask, pressure sensitive adhesive on the peripheral edge of the smoke mask structure on one surface thereof for securing the mask structure to the face of the user covering the mouth, nose and eyes of the user in a substantially airtight manner, and a release sheet covering the adhesive, wherein the adhesive is exposed upon removal of the release sheet, the breathing filter having a filter efficiency of at least about 95%, wherein the breathing filter removes at least about 95% of charge neutralized particles having an approximate size of 0.3 micrometers from air flowing at a rate in a range of about 81 liters per minute to about 89 liters per minute, with a total filter load of at least about 200 milligrams of the particles; and a storage canister in which the smoke mask structure is stored until use.

15. The combination according to claim 14 wherein the smoke mask structure is stored in the canister in a rolled position.

16. The combination according to claim 14 further comprising at least one slit in the peripheral edge of the mask structure for enabling the mask structure to adapt to the contour of the face of the user.

17. The combination according to claim 14 wherein the mask structure comprises at least one pull-apart tab for being grasped by a user.

18. The combination according to claim 14 wherein the mask structure further comprises a transparent eye shield in attachment with the breathing filter.

19. The combination according to claim 18 wherein the eye shield is selected from the group consisting of plastic film or goggles.

20. The smoke mask according to claim 14 wherein the release sheet is constructed of a plastic film.

21. The combination according to claim 14 wherein the canister is sealed by means of a pull-off cover or a threaded cover.

22. The smoke mask according to claim 14 wherein the canister comprises threaded halves.

23. The smoke mask according to claim 14 wherein the breathing filter comprises a dry material.

24. The smoke mask according to claim 14 wherein the breathing filter comprises a moistened material and wherein the canister is substantially air-tight.

* * * * *